US006374931B1

(12) United States Patent
Nieves

(10) Patent No.: US 6,374,931 B1
(45) Date of Patent: Apr. 23, 2002

(54) MULTIPLE CUTTER ROTARY HAMMER BIT

(75) Inventor: Marcelo Reyes Nieves, Pasadena, CA (US)

(73) Assignee: Relton Corporation, Arcadia, CA (US)

( * ) Notice: Subject to any disclaimer, the term of this patent is extended or adjusted under 35 U.S.C. 154(b) by 0 days.

(21) Appl. No.: 09/697,385

(22) Filed: Oct. 26, 2000

Related U.S. Application Data

(60) Provisional application No. 60/163,296, filed on Nov. 3, 1999.

(51) Int. Cl.[7] ..... E21B 10/40

(52) U.S. Cl. ..... 175/420.1; 175/431; 299/87.1

(58) Field of Search ..... 175/417, 420.1, 175/430, 431, 432, 427, 394, 385; 299/87.1, 100, 101, 113

(56) References Cited

U.S. PATENT DOCUMENTS

| | | | | | |
|---|---|---|---|---|---|
| 2,858,109 | A | | 10/1958 | Tengberg | |
| 2,960,223 | A | | 11/1960 | Fauth | |
| 3,773,122 | A | | 11/1973 | Chromy | |
| 4,291,774 | A | * | 9/1981 | Sudnishnikov et al. | 175/417 |
| 4,729,441 | A | * | 3/1988 | Peetz et al. | 175/385 |
| 4,911,729 | A | * | 3/1990 | Rooker | 175/393 |
| 4,942,931 | A | | 7/1990 | Moser | |
| 4,951,761 | A | * | 8/1990 | Peetz et al. | 175/398 |
| 5,403,130 | A | | 4/1995 | Moser et al. | |
| 5,482,124 | A | | 1/1996 | Haussmann et al. | |
| 5,492,187 | A | * | 2/1996 | Neukirchen et al. | 175/394 |
| 5,836,410 | A | | 11/1998 | Kleine | |
| 6,089,337 | A | | 7/2000 | Kleine et al. | |
| 6,102,634 | A | | 8/2000 | Turner et al. | |
| 6,116,361 | A | | 9/2000 | Kleine et al. | |
| 6,129,162 | A | * | 10/2000 | Hauptmann | 175/394 |

* cited by examiner

*Primary Examiner*—Frank Tsay
(74) *Attorney, Agent, or Firm*—Lyon & Lyon LLP

(57) ABSTRACT

A drill bit for use in rotary hammer drilling machines to drill holes in rock, masonry and concrete which includes an axially extending shank having a plurality of helical discharge grooves therein and defining a convex end face. A cylindrical projection is centrally disposed on the end face of the shank and defines a pyramid-shaped cutting tip. A plurality of primary cutting members, generally rectangular in configuration, are embedded in the shank such that the cutting members are spaced from and extend radially from the cylindrical projection so as to define gaps between the cutting members and the projection. One of the cutting members is laterally adjacent an upper end portion of each of the discharge grooves. The combination of the cylindrical projection and surrounding primary cutting members pulverize and pressurize drilled material and direct drilled material along the side wall of the cylindrical projection and into the gaps between the projection and the primary cutting members where the material is compressed to assist in the drilling process and enhance drilling speed and is subsequently directed into the discharge grooves for removal.

13 Claims, 2 Drawing Sheets

MULTIPLE CUTTER ROTARY HAMMER BIT

This application claims the benefit of U.S. Provisional Patent Application Serial No. 60/163,296, filed Nov. 3, 1999.

BACKGROUND OF THE INVENTION

The present invention relates to a drill bit for use in rotary hammer drilling machines to make holes in rock, masonry and concrete. Such bits are well known and typically employ an axially extending shank having a pair of dust-removing helical grooves therein and hard metal cutting edges positioned at the forward end of the shank. The cutting edges generally extend over the entire diameter of the drill head in a variety of configurations and exert a grinding type action on the stone, masonry or concrete to cut into the material and form a borehole. In an effort to enhance the durability and precision of the drilling operation and reduce the wear on the cutting edges and jamming of the drill bit, different drill head cross sections have been employed and a wide variety of cutting edge configurations have been developed. Such edges are formed by a plurality of hard metal plates and/or pins which are embedded in the face of the shank, extend across the face and project axially therefrom. These cutting plates are frequently arranged in a variety of cross-shaped forms wherein one of the plates extends across the diameter of the shank to define the main cutting edges. This plate is often V or roof-shaped to define a centering point. The auxiliary cutting edges are formed from smaller plates projecting perpendicularly or at acute angles from the main plate. Examples of such drills are shown and discussed in U.S. Pat. Nos. 5,836,410; 5,482,124 and 3,960,223. While capable of forming boreholes in rock, masonry and concrete, these drill bits have certain shortcomings. Centering of the borehole becomes difficult as drilling progresses due to the overhang of the main cutting plate relative to the cylindrical sides of the drill head. As a result, it is difficult to maintain a straight and cylindrical borehole. Reinforcing steel ("rebar") also presents a problem as the roof-style points on the main cutting edge tend to slide off the rebar and allow the drills to progress against the sides of the reinforcing steel until the drill jams or breaks. The drill of the present invention overcomes the shortcomings in the prior art bits and thereby provides a new and improved hammer bit.

SUMMARY OF THE INTENTION

Briefly, the present invention comprises a drill bit for use in rotary hammer drilling machines which includes an axially extending shank having a plurality of discharge grooves therein, a centrally disposed cylindrical projection embedded in a convex end face of the shank, and terminating at its extended end in a pyramid-shaped point, and a plurality of primary cutters disposed about and spaced radially from the cylindrical projection. The pointed cylindrical projection permits precise location of the drill hole and minimizes wandering of the bit in creating a pilot hole. It also provides a chiseling effect to pulverize the rock, masonry or concrete as opposed to the grinding-type action of roof-shaped bits. The inclined surface of the pyramid point is multi-faceted and the facets are oriented so as not only to define the pyramid point but also to channel the comminuted material down the straight cylindrical side wall of the central projection and into the gaps between the central projection and the outer primary cutters where the material is compressed against the rock or other material being drilled and itself provides a grinding effect on the material being drilled to assist the primary cutters and pointed cylindrical projection in the drilling process and thus enhances the drilling speed. The configuration of the pyramid-shaped tip on the central projection also causes the drill to flare rebar upon contact and sit in the contact point so as to maintain a true drilling line and alert the driller to the presence of the rebar to prevent damage to the drill bit.

Accordingly, it is the object of the present invention to provide a drill bit for use in rotary hammer drilling machines which exhibits improved accuracy and enhanced drilling speed and which is less likely to be damaged when encountering rebar.

These and other objects and advantages of the present invention will become readily apparent from the following detailed description taken in conjunction with the accompanying drawings.

IN THE DRAWINGS

DETAILED DESCRIPTION OF THE PREFERRED EMBODIMENT

Figure 5:
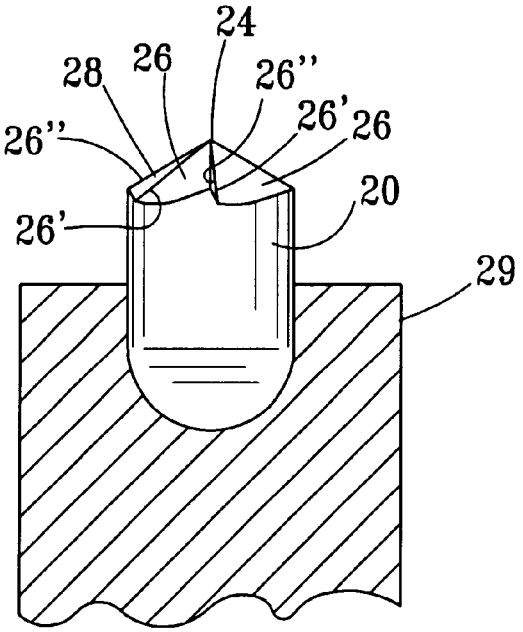
FIG. 5 is a sectional view taken along the line 5—5 in FIG. 4.

Referring now in detail to the drawings, the drill bit 10 of the present invention comprises an axially extending shank 12 terminating in a continuously convexly-shaped end face 14 and defining two material discharge helical grooves 16 and 18 therein. The end face 14 of shank 12 has a centrally disposed cylindrical projection 20 extending axially therefrom along the central axis of the shank 12. Projection 20 is formed of a hard, abrasion/percussion-resistant material such as carbide and preferably embedded in a center hole in the end face 14 and securely affixed by brazing or other suitable means. While the brazing may slightly interrupt the contour of the shank end face 14, the end face is otherwise generally convex over its entire surface. As used herein, the term "continuously convex" allows for such minor interruptions in contour. Projection 20 terminates at its extended end in a generally pyramid-shaped configuration defining a plurality of inclined facets terminating at their lower ends in the straight cylindrical side wall of projection 20 and at their upper ends in a centrally disposed pyramid point 24. In the preferred configuration of projection 20, point 24 is defined by four inclined larger or primary facets 26 and four smaller or secondary facets 28. As best seen in FIG. 5, each secondary facet 28 extends at upward and rearward inclinations between the trailing edge 26' of one of the primary facets 26 and the leading edge 26" of an adjacent primary facet.

Figure 1:
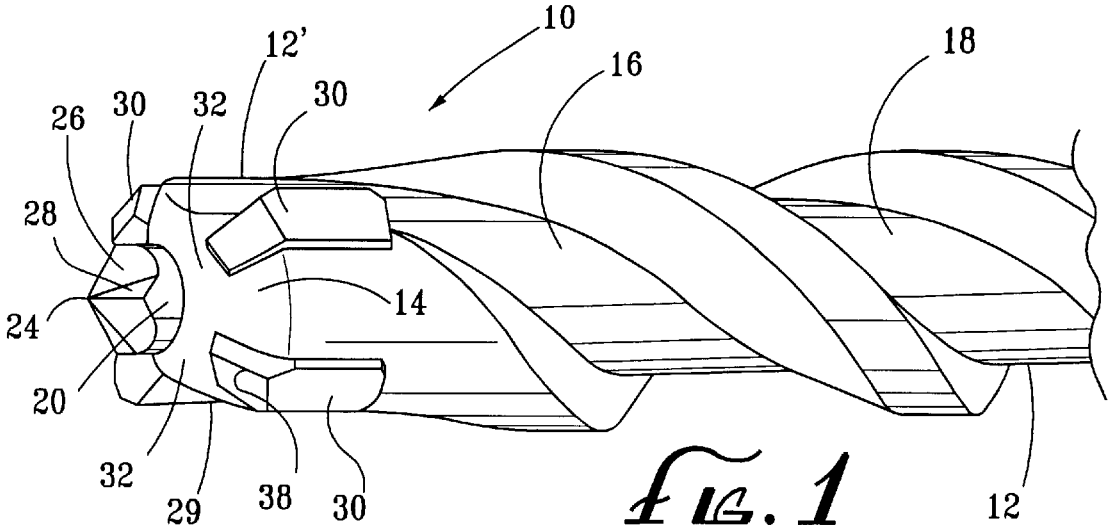
FIG. 1 is a prospective view of a portion of the drill bit of the present invention showing the head and shank portions of the bit.
Figure 3:
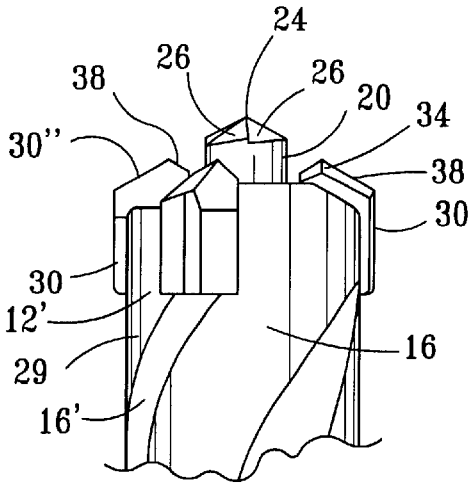
FIG. 3 is a side view of the head portion of the drill bit of the present invention.
Figure 2:
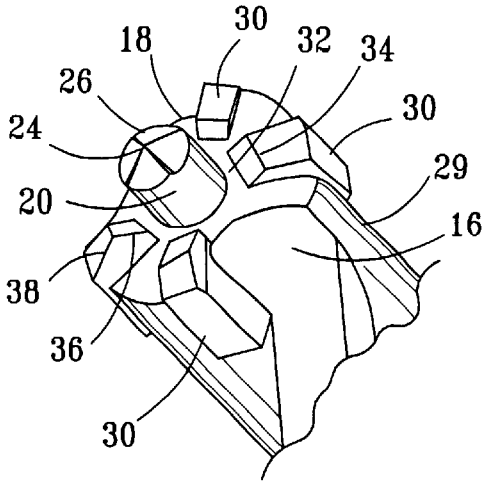
FIG. 2 is a prospective view of the head portion of the drill bit of the present invention showing access to the helical portion of the shaft.
Figure 4:
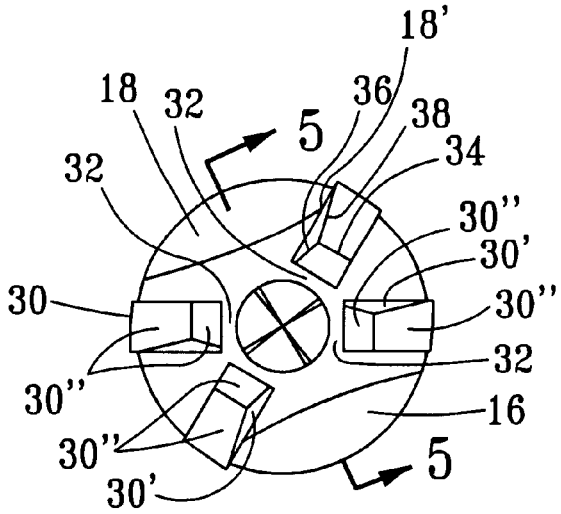
FIG. 4 is an end view of the drill bit of the present invention showing the top of the head portion thereof.
Figure 6:
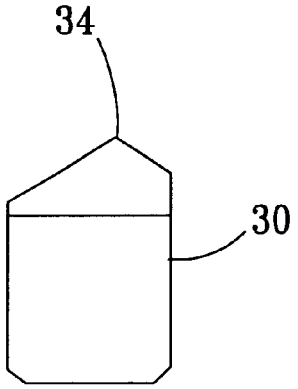
FIG. 6 is a side view of one of the primary cutters employed in the present invention.
Figure 7:
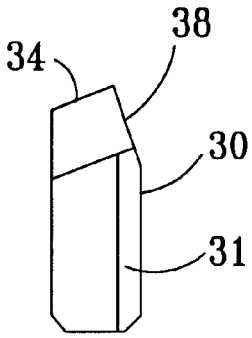
FIG. 7 is an end view of one of the primary cutters employed in the present invention.

A plurality of primary cutters 30 are also embedded in the end face 14 of the shank 12 and, with central projection 20 and the extended end portion 12' of shank 12, define a drill head 29. While the number of primary cutters can vary, four such primary cutters 30 are preferably employed in the drill head and, like projection 20, cutters 30 are formed of a hard, abrasion/percussion resistant material such as carbide. As few as two such cutters could be employed, and in larger diameter drills six or more primary cutters could be employed. The primary cutters 30 are generally rectangular in configuration and are positioned in the periphery of the drill head 29 so as to surround the central projection 20 and provide radial spacings or gaps 32 between cutters 30 and projection 20. As seen in FIGS. 2–4, the primary cutters 30 are also positioned in the drill head such that one of said cutters is embedded in the upper end portion of the trailing edges 16' and 18' of each of grooves 16 and 18 so that the cutters extend axially along the grooves for directing drilled material from the drilled hole to the discharge grooves 16 and 18.

While the primary cutters 30 can vary in configuration, the preferred configuration is illustrated in FIGS. 1–6. As seen therein, each cutter 30 has a rearwardly beveled side portion 31 and defines at its upper end a rearwardly and upwardly inclined facet 30' and a pair of adjacent rearwardly declining and radially converging facets 30" so as to define cutting edges 34, 36 and 38. If desired, serrations could be cut in edges 34, 36 and 38 to further increase drilling speed. Terms such as "rearwardly", "forwardly", "leading edge" and "trailing edge" are used herein with reference to the direction of rotation of the drill bit 10 during drilling, which would be clockwise as viewed by the person operating the drilling machine and counterclockwise as viewed from the orientations of FIGS. 2–4 in the drawings.

The primary cutters 30 also project in a radial direction a slight distance beyond the outer perimeter of the drill body. In the preferred embodiment of the present invention, this overhang or radial projection of the primary cutters beyond the perimeter of the drill body is only about 1/32 of an inch. This small overhang has been found to reduce friction and binding of the fluted drill body in the hole while minimizing any variation from true axial straightness in the drilling process. As a result, the drill bit 10 avoids cutting a somewhat elliptically shaped hole which would occur with excessive overhang and is common with drills employing roof-style carbide centering points or other conventional cutting ends.

In use, the sharp tip of the pyramid point 24 has been found to provide drill bit 10 with superior hole-centering for precise location of the drill hole. The pyramid point continues to perform that function as drilling progresses as a result of its configuration and the straight cylindrical side wall of projection 20. The point centering capability of projection 20 in combination with the above-described small overhang of the primary cutters 30 beyond the perimeter of the shank creates extremely straight holes as contrasted with other drills with roof-style carbide centering points or conventional cutting ends. The primary and secondary facet configuration also provides the central projection 20 with an effective cutting or chiseling configuration to compliment the primary cutters 30 in the drilling process. In addition, the trailing secondary facets 28 defined by the pyramid-shaped cutting point 24 cooperate with the spacings 32 between projection 20 and cutters 30 by pulverizing, pressurizing, and channeling the comminuted material over and down the sides of the pyramid point and down the side wall of projection 20 into spacings 32 where the dust is compressed against the rock, masonry or concrete in the spacings and assists in the breaking or crushing of such rock, masonry or concrete into pulverized dust. As a result, the drilling speed is enhanced by obviating the need to otherwise cut or break up the material disposed between projection 20 and cutters 30.

Various changes and modifications may be made in carrying out the present invention without departing from the spirit and scope thereof Insofar as the changes and modifications are within the purview of the appended claims, they are to be considered as part of the present invention.

I claim:

1. A drill bit for use in rotary hammer drilling machines comprising an axially extending shank having a plurality of helical discharge grooves therein and terminating in a convex end face, a cylindrical projection centrally disposed on said end face, projecting axially therefrom and terminating in a centrally disposed cutting tip, and a plurality of generally rectangular primary cutting members disposed about and radially spaced from said cylindrical projection so as to define gaps along said convex end face between said cutting members and said projection, and wherein said discharge grooves each define a leading edge and a trailing edge and one of said cutting members is embedded in an upper end portion of a trailing edge of each of said grooves and extends axially along said groove for directing drilled material into said groove.

2. The drill bit of claim 1 wherein said primary cutting members each define a plurality of angularly disposed facets thereon, one of said facets being disposed adjacent to and inclined from an upper end portion of each of said discharge grooves.

3. The drill bit of claim 2 wherein said primary cutting members project radially from said end face of said shank a distance of about 1/32 of an inch.

4. The drill bit of claim 2 wherein said cylindrical projection defines a first plurality of facets terminating in said tip and a second plurality of facets terminating in said tip, each of said first plurality of facets defining a leading edge and a trailing edge, each of said second plurality of facets extending at an upward inclination between a trailing edge of one of said first plurality of facets and a leading edge of another of said first plurality of facets whereby drilled material is pulverized and pressurized by said cylindrical projection and channeled by said cylindrical projection into said gaps between said projection and said primary cutting members for compression of said material to assist in the drilling process and enhance drilling speed.

5. The drill bit of claim 4, wherein said primary cutting members project radially from said end face of said shank a distance of about 1/32 of an inch.

6. The drill bit of claim 1 wherein said cylindrical projection defines a plurality of primary facets and secondary facets, said primary and second facets terminating in said cutting tip and wherein said secondary facets are inclined between a trailing edge of one of said primary facets and a leading edge of another of said primary facets.

7. The drill bit of claim 1 wherein said cylindrical projection defines a first plurality of facets terminating in said tip and a second plurality of facets terminating in said tip, each of said first plurality of facets defining a leading edge and a trailing edge, each of said second plurality of facets extending at an upward inclination between a trailing edge of one of said first plurality of facets and a leading edge of another of said first plurality of facets whereby drilled material is pulverized and pressurized by said cylindrical projection and channeled by said cylindrical projection into said gaps between said projection and said primary cutting members for compression of said material to assist in the drilling process and enhance drilling speed.

8. The drill bit of claim 1 wherein said cutting tip is pyramid-shaped, defined by a plurality of inclined facets extending from said cylindrical projection such that said tip and said projection are of single piece construction.

9. The drill bit of claim 8 wherein said cylindrical projection and said pyramid-shaped cutting tip are formed of carbide.

10. A drill bit for use in rotary hammer drilling machines comprising an axially extending shank having a plurality of helical discharge grooves therein and terminating in a convex end face, a cylindrical projection centrally disposed on said end face, projecting axially therefrom and terminating in a plurality of inclined facets defining a centrally disposed pyramid-shaped cutting tip, and a plurality of primary cutting members disposed about and radially spaced from said projection so as to define gaps along said convex end face between said cutting members and said projection, one of said cutting members being laterally adjacent each of said grooves for directing drilled material into said grooves and wherein said inclined facets on said central projection are configured so as to pulverize and pressurize drilled material and to direct drilled material along said central projection and into said gaps for compression of said material to assist in the drilling process and enhance drilling speed.

11. The drill bit of claim 10 wherein said primary cutting members project radially from said end face of said shank a distance of about 1/32 of an inch.

12. The drill bit of claim 10 wherein said facets comprise a plurality of primary facets and a plurality of secondary facets, said secondary facets being inclined between a trailing edge of one of said primary facets and a leading edge of another of said primary facets.

13. The drill bit of claim 12 wherein said primary cutting members project radially from said end face of said shank a distance of about 1/32 of an inch.

* * * * *